United States Patent [19]

Ikegami et al.

[11] 4,217,060

[45] Aug. 12, 1980

[54] SYNTHETIC RESIN NIB

[75] Inventors: Kouzaburo Ikegami, Ibaraki; Yasumasa Morio; Hitoshi Sakai, both of Osaka, all of Japan

[73] Assignee: Sakura Color Products Corporation, Osaka, Japan

[21] Appl. No.: 954,166

[22] Filed: Oct. 24, 1978

Related U.S. Application Data

[63] Continuation-in-part of Ser. No. 776,374, Mar. 10, 1977, abandoned.

[30] Foreign Application Priority Data

Mar. 11, 1976 [JP] Japan ..... 51-29359

[51] Int. Cl.[2] ..... B43K 1/06

[52] U.S. Cl. ..... 401/265; 401/292

[58] Field of Search ..... 401/265, 292

[56] References Cited

U.S. PATENT DOCUMENTS

| | | | |
|---|---|---|---|
| 3,338,216 | 8/1967 | Roller, Sr. | 401/265 |
| 3,518,019 | 6/1970 | Nakamura | 401/265 |
| 3,520,629 | 7/1970 | Otsuka | 401/265 X |
| 3,614,248 | 10/1971 | Otsuka | 401/292 |
| 3,718,401 | 2/1973 | Kiriu | 401/265 X |
| 3,729,270 | 4/1973 | Nakaho | 401/292 |
| 3,778,495 | 12/1973 | Woolley | 401/265 X |
| 3,843,270 | 10/1974 | Kiriu et al. | 401/292 |
| 3,932,044 | 1/1976 | Otake | 401/265 |
| 3,933,965 | 1/1976 | Gallone et al. | 401/265 X |
| 3,969,027 | 7/1976 | Randar et al. | 401/292 X |

*Primary Examiner*—Clifford D. Crowder

*Attorney, Agent, or Firm*—Wenderoth, Lind & Ponack

[57] ABSTRACT

A synthetic resin nib includes a stick-shaped body having a writing tip at one end and radial slots extending through the length of the stick-shaped body. The cross section of each of the radial slots is such that it becomes wider at the middle portion and tapers toward both a central axis of the stick-shaped body and outer periphery thereof.

5 Claims, 10 Drawing Figures

SYNTHETIC RESIN NIB

This application is a continuation-in-part of the Inventors' application, Ser. No. 776,374, filed on Mar. 10, 1977, now abandoned.

The present invention relates to a synthetic resin nib of a marking pen and the like.

BACKGROUND AND SUMMARY OF THE INVENTION

U.S. Pat. No. 3,518,019 discloses a synthetic resin nib of this kind. FIGS. 1 and 2 of the accompanying drawings illustrate the prior art. As appears, the nib comprises a tube 1 having a substantially conical writing tip 2 and radial slots 3 extending through the length of the tube 1. The cross section of each of the slots 3 is of wedge-like shape and tapers toward the central axis 4 so that the slots 3 gather at the axis 4. In the nib, when the writing tip 2 is directed upwardly, the ink A rises higher adjacent the central axis 4 by the stronger capillary action, as shown by the dot-dash lines in FIG. 1, since the cross sectional inner ends of the slots 3 become narrower, thus causing the ink A to be thicker about the central portion of the writing tip 2. This structure has an advantage in that it assures immediate use of a writing instrument. However, upon beginning to write with the nib by directing it downwardly, just the center of the writing tip 2 should be contacted to a paper. Therefore, it takes some time after holding the nib downwardly until the ink A comes down along the slots 3 to fill them entirely at the writing tip 2 so as to make it possible to write at any angle of the writing tip, i.e., with the entire surface about the writing tip.

A primary object of the present invention is to obviate the above defect, and to provide a nib enabling the immediate use at any angle even after it was directed upwardly for a long while.

BRIEF DESCRIPTION OF DRAWINGS

Other objects and features of the present invention will be apparent from the following description of the invention with reference to the accompanying drawings, in which.

DETAILED DESCRIPTION OF THE INVENTION

Figure 1:
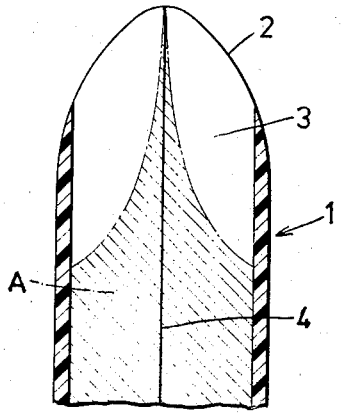
FIG.1 PRIOR ART
FIG. 1 is a longitudinal section of a prior art nib.
Figure 2:
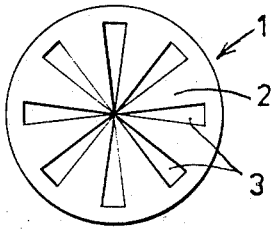
FIG.2 PRIOR ART
FIG. 2 is a plan view of the above.

Throughout the drawings, similar parts and elements are designated by the similar reference numerals and letters.

Figure 3:
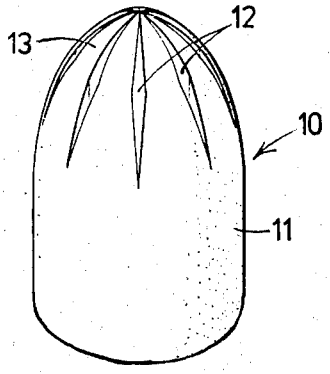
FIG. 3 is a perspective view of a nib of the present invention.
Figure 4:
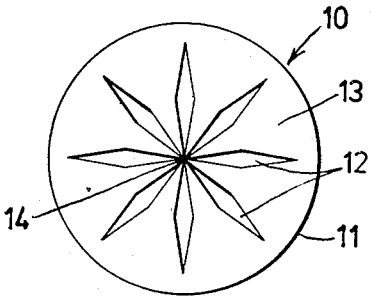
FIG. 4 is a plan view of the same.
Figure 5:
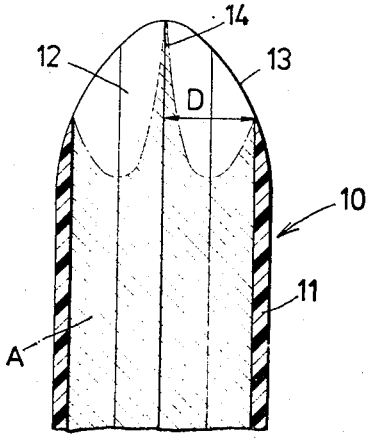
FIG. 5 is a longitudinal section of the same.

Referring now to FIGS. 3 through 5, a nib of the present invention generally indicated at 10 comprises a synthetic resin stick-shaped body 11 having a substantially circular cross section and radial slots 12 extending through the length of the stick-shaped body 11. One end of the stick-shaped body 11 is substantially conical and serves as a writing tip 13, and the other end (not shown) is connected to a suitable ink reservoir. The writing tip 13 may be rounded, as shown.

Each of the radial slots 12 is substantially rhombic in cross section so that it becomes wider at the middle portion and tapers toward both the central axis 14 and outer periphery of the stick-shaped body 11. Instead of a rhomb-like shape, the side walls of the slots 12 can be smoothly curved.

Figure 6:
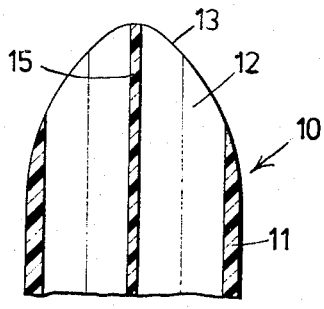
FIG. 6 is a longitudinal section showing a slight modification of a nib of FIG. 5.

Cross sectional inner ends of the slots 12 gather together at the central axis 14 so as to communicate with each other, as appears from FIG. 4. However, as shown in FIG. 6, the communication may be blocked by a center core 15.

According to the nib 10 of the present invention, when the writing tip 13 is directed upwardly, the ink A in each of the slots 12 is drawn toward both the central axis 14 and the outer periphery of the stick-shaped body 11 by the stronger capillary action, thus causing the ink A to rise higher at the cross sectional ends of the slot 12, as shown by the dot-dash lines in FIG. 5. When it is desired to write by directing the writing tip 13 downwardly, the slots 12 at the writing tip 13 will be immediately filled with ink A since an actual length D between the inner and outer ends of each slot 12 is very short. However, even before the slots 12 are completely filled with ink, if either the central or base portion of the writing tip 13 where the ink is thicker is initially contacted to a paper, it is possible to write immediately. Therefore, with a writing instrument which has had the writing tip directed upwardly for a long while, it is possible to start writing without thin letterings with little lapse of time for lowering the ink.

Though not shown in the drawings, the stick-shaped body 11 may be elliptical or polygonal in cross section.

Figure 8:
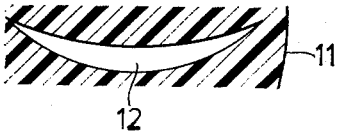
FIGS. 7 and 8 are enlarged cross sectional views illustrating modifications of a slot.
Figure 7:
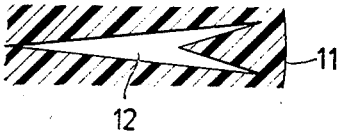

Further, each of the slots 12 may have a forked end like an arrowhead at the cross sectional outer end, as shown in FIG. 7, or may be crescent-shaped or semi-circular, as shown in FIG. 8. There may be employed any other similar shape which is wider at the middle portion and tapers toward the inner and outer ends.

Figure 9:
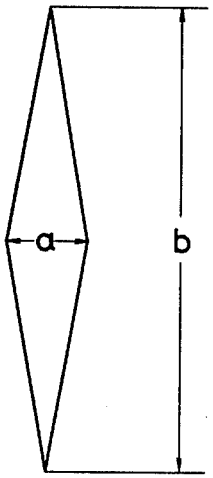
FIGS. 9 and 10 show two dimensioned embodiments of slots of the invention.
Figure 10:
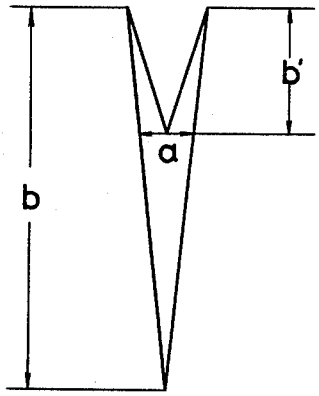

In the embodiments presented herein, the proper dimensions for the various slots preferably fall within the following ranges. For the slots represented in FIGS. 9 and 10, suppose that the maximum slot width is "a", the slot length from end to end is "b", and the length from the outer end to the widest portion in the slot having a forked outer end is "b'". The size of slot, then, should be within these ranges:

$a = 20\text{–}80$ microns $2a < b < 10a$ $\frac{1}{4}b < b' < \frac{1}{2}b$

If a were less than 20 microns, ink would rise in the slot to a sufficient height, but the interfacial tension between ink and the inner wall of the slot would be too large to permit ink to flow smoothly onto the writing surface. If a were more than 80 microns, the interfacial tension would be too small to keep ink at a sufficient height. Ink would drop by its own weight.

If b were equal to or less than 2a, the angle at the ends of slot would be too obtuse to provide a sufficient interfacial tension.

If b' were larger than $\frac{1}{2}b$, the angle of each branch of the forked slot at its outer end would be too sharp so that the interfacial tension would be too large to allow smooth flow of ink onto the writing surface.

What is claimed is:

1. A writing tip comprising a single, synthetic resin stick rod having a body portion and a writing tip portion integrally formed with said body portion, said body and writing tip portions having a plurality of longitudinal slots therethrough, each said slot radiating from the longitudinal axis of said body and tip portions toward the outer circumference thereof, each said slot having a radially outer end forked adjacent said outer circumference and a radially inner end like an arrowhead in cross section adjacent said axis, and each said slot having substantially narrower volumes toward said ends thereof than at the center portion thereof, said slots being such a size that:

$a = 20$ to 80 microns $2a < b$ wherein a is the slot width at its widest portion, and b is the slot length.

2. A writing tip as claimed in claim 1, wherein said slot is of such a shape that $\frac{1}{4}b < b' < \frac{1}{2}b$ wherein b is the length of slot from end to end and b′ is the length from its outer end to the widest portion.

3. A writing tip as claimed in claim 1 wherein said writing tip is substantially conical.

4. A writing tip as claimed in claim 1 wherein said writing tip is rounded.

5. A writing tip as claimed in claim 1, wherein said slots are joined together and communicate with each other at said longitudinal axis.

* * * * *